US005686009A

United States Patent [19]

Gregersen

[11] Patent Number: 5,686,009

[45] Date of Patent: Nov. 11, 1997

[54] MOULD

[75] Inventor: Agner Rask Gregersen, Viborg, Denmark

[73] Assignee: Maskin Industri Viborg A/S, Roedkaersbro, Denmark

[21] Appl. No.: 666,575

[22] PCT Filed: Jan. 6, 1995

[86] PCT No.: PCT/DK95/00007

§ 371 Date: Jul. 1, 1996

§ 102(e) Date: Jul. 1, 1996

[87] PCT Pub. No.: WO95/18703

PCT Pub. Date: Jul. 13, 1995

[30] Foreign Application Priority Data

Jan. 7, 1994 [DK] Denmark ..... 0034/94

[51] Int. Cl.[6] ..... B28B 7/24

[52] U.S. Cl. ..... 249/120; 249/119; 249/135; 425/253

[58] Field of Search ..... 249/128, 124, 249/125, 129, 132, 119, 118, 120, 127, 139; 425/DIG. 111

[56] References Cited

U.S. PATENT DOCUMENTS

| | | | |
|---|---|---|---|
| 848,955 | 4/1907 | Bartlett . | |
| 4,050,188 | 9/1977 | Van Wingerden | 249/128 |
| 4,343,453 | 8/1982 | Rodon | 249/124 |
| 4,389,036 | 6/1983 | Abou-Ezzeddine | 249/124 |
| 4,442,995 | 4/1984 | Grady, II | 249/139 |

FOREIGN PATENT DOCUMENTS

| | | |
|---|---|---|
| A1-2710643 | 9/1978 | European Pat. Off. . |
| A1-2934838 | 3/1981 | European Pat. Off. . |

*Primary Examiner*—Jay H. Woo
*Assistant Examiner*—Robert Hopkins
*Attorney, Agent, or Firm*—Antonelli, Terry, Stout & Kraus, LLP.

[57] ABSTRACT

A mold for producing molded concrete items is disclosed. The mold includes a mold frame; a plurality of spaced apart mold cavities contained within the mold frame for receiving concrete and forming of individual concrete items upon curing of the concrete received therein; and an elastic casting material positioning the plurality of spaced apart mold cavities within the mold frame while permitting movement of the mold cavities within the mold space with the elastic casting material contacting side walls of the mold and filling spaces between the spaced apart mold cavities and contacting outer walls of the spaced apart mold cavities.

27 Claims, 2 Drawing Sheets

FIG. 1
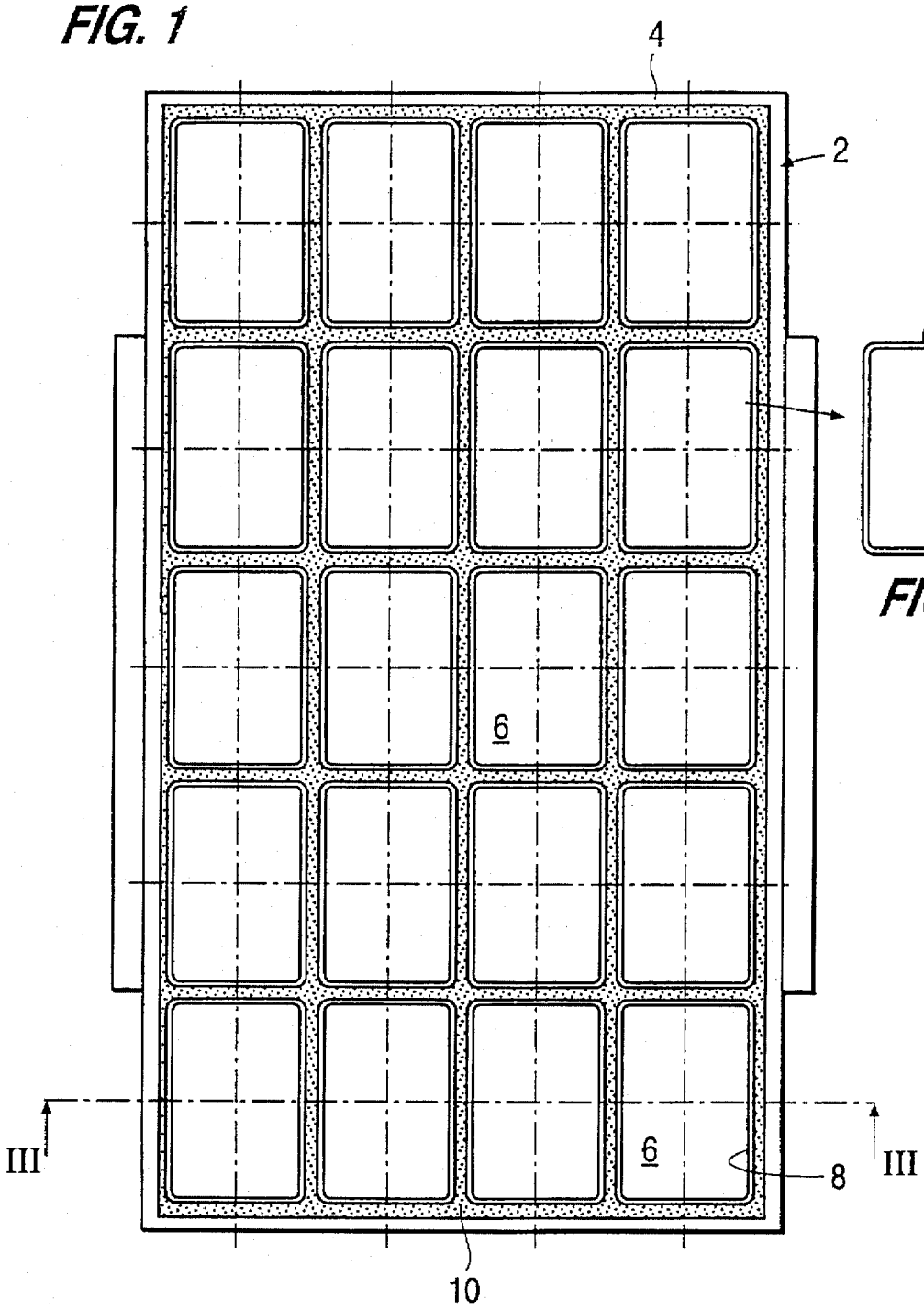
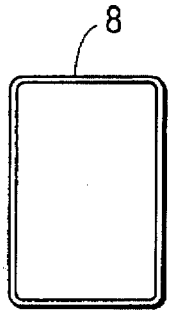
FIG. 2
FIG. 3
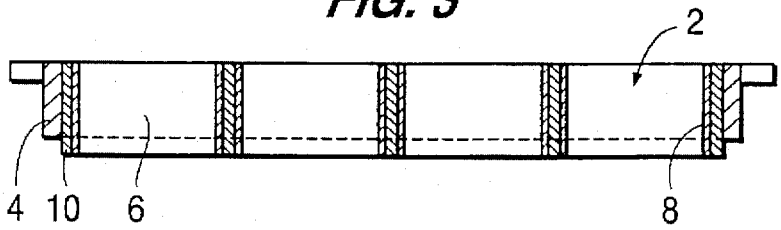

MOULD

BACKGROUND OF THE INVENTION

1. Field of the Invention

The present invention relates to molds for producing concrete items.

2. Description of the Prior Art

Molds for the production of relatively simple concrete items such as pavement stones, which are produced in large number, are usually used in automatic or semi-automatic casting machinery. Normally molds of this type are adapted to simultaneous production of a large number of pavement stones, for instance a whole pallet layer of pavement stones, which possibly also may be intended for machine laying.

Molds of this type are rather expensive to produce, and their life is relative short because of rapid wear. The mold frame which is provided with mold cavities corresponding to the outer shape of the concrete item, may be produced in several manners, namely either by flame cutting of the individual mold cavity in a solid steel plate with a thickness equal to the thickness or height of the concrete items or by molding in a suitable mold material, also with a thickness of the mold equal to the thickness or height of the concrete items. Furthermore it is known to produce the mold frame by welding.

In producing the concrete molds of this type the time factor is of great importance because there is a relatively long time of delivery of new molds, which is due to the fact that several working processes often are involved. The actual manufacturing of molds often demands expert work, for instance for the subsequent treatment such as hardening of molds, etc. Therefore damage to the mold may cause large working deficits because of the long time of delivery for replacement molds. Furthermore it is a problem to obtain sufficient dimensional accuracy. DE-A1-29 34 838 discloses a mold frame with a number of mold boxes, produced from cast iron by a casting that is screwed to the mold frame.

SUMMARY OF THE INVENTION

The purpose of the invention is to provide a mold for casting concrete items which by simple provisions results in a considerable reduction in the time of production and a considerable reduction in the price of the molds.

A mold according to the invention has mold cavities having individual mold boxes which preferably are made from thin metal plate, and which preferably are positioned with a mutual and uniform distance in a mold frame and secured to the mold frame by means of a molding material cast thereto for forming the mold. By means of simple provisions a considerable reduction in the production time and a considerable reduction in the price of the molds is obtained. Furthermore, the total weight of the mold is considerably reduced, which results in energy efficiency in connection with vibration of the mold by the casting operation. The individual mold boxes, which may be produced in an effective and inexpensive manner, may be stocked in large number, so that the time of delivery in connection with the mold production is reduced considerably, as mold boxes of a desired shape may be quickly placed and secured by casting in a standard mold frame.

In order to make the mold lighter and quieter in accordance with the invention the mold boxes are secured by casting in the mold frame by means of a molding material consisting of or containing an elastic material so that the mold boxes are mutually movable.

Preferably the mold boxes are secured by casting in the mold frame by means of a molding material consisting of or containing rubber, so that the mold boxes are mutually movable.

To make a vibration casting method more effective, the mold according to the invention may advantageously be provided with the mold boxes secured by casting to the mold frame in such a manner, that the mold boxes and the molding material project downwardly outside the mold frame so that mold boxes or mold cavities individually touch the vibration table or supporting plate and at the same time the surrounding casting material has a sound-absorbing effect.

BRIEF DESCRIPTION OF THE DRAWINGS

The invention is described herewith in more detail with reference to preferred embodiments with reference being made to the accompanying drawings in which:

FIG. 1 shows a plane view of an embodiment of a mold frame in accordance with the invention as viewed from above;

FIG. 2 shows an embodiment of a mold box of the mold frame shown in FIG. 1;

FIG. 3 shows a sectional view of the mold frame taken along section line III—III in FIG. 1;

DESCRIPTION OF THE PREFERRED EMBODIMENTS

Figure 4:
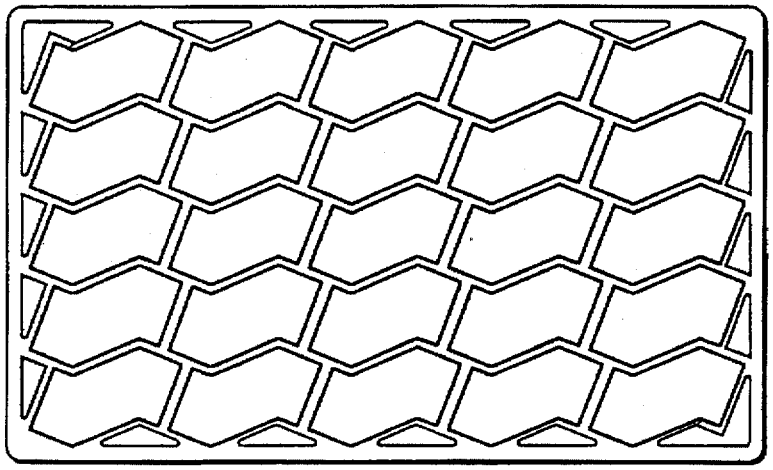
FIG. 4 shows a plane view of another embodiment of a mold frame according to the invention.

The mold 2 shown in FIGS. 1–3 according to the invention has a mold frame 4 containing a number of mold cavities 6 which are formed by loose mold boxes 8 (FIG. 2). These boxes are positioned as shown in the mold frame 4, before the form boxes 8 are secured by casting in the mold frame by means of a molding material 10 consisting or containing rubber. As shown in FIG. 3 the mold boxes 8 and the molding material 10 project below the mold frame 4 so that the mold boxes 8 individually are supported on a vibration table and supporting plate, respectively, of the mold machine. At the same time the mold frame 4 is noise dampened by means of the molding material 10 surrounding the mold boxes 8.

The mold boxes 8 are made from a thin steel plate, which after rolling and welding, and preferable mold pressing of side projecting which preferably are hardened to provide a long life of the mold. The mold boxes 8 are inexpensive to produce and as a result may be stocked in large numbers with variable configurations so that the time of delivery of the molds may be reduced considerably because it is possible to quickly secure by casting the mold boxes in a mold frame which also is a stock good.

Figure 5:
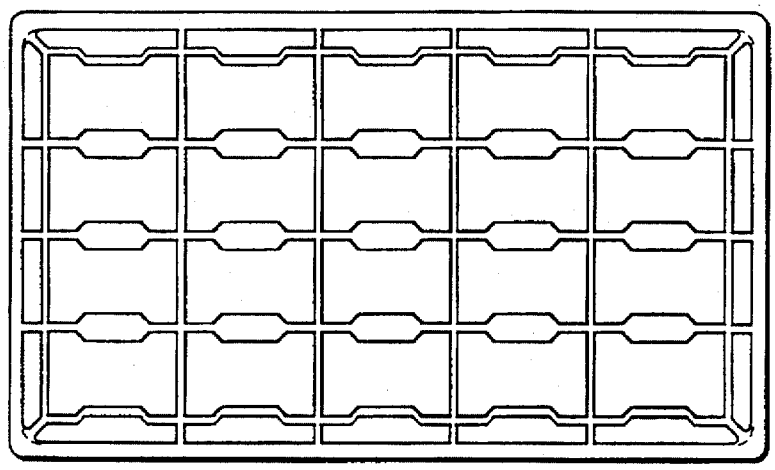
FIG. 5 shows a plane view of a further embodiment of a mold frame according to the invention.
Figure 6:
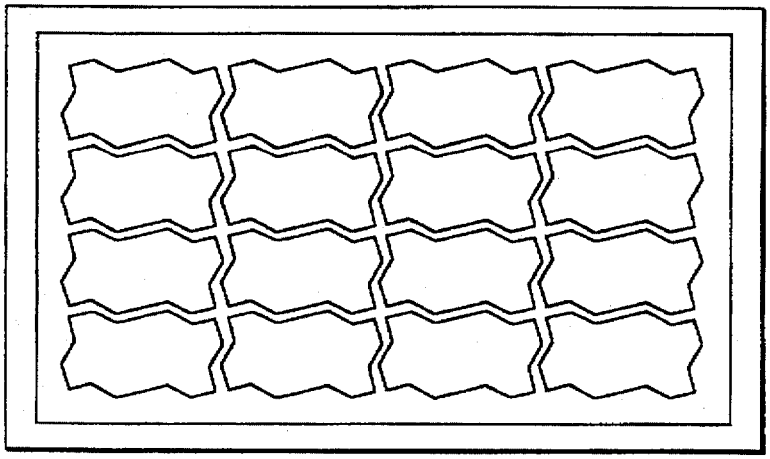
FIG. 6 shows a plane view of a still further embodiment of a mold frame according to the invention.

FIGS. 4–6 show alternative embodiments of mold frames in accordance with the invention which in a similar manner may be constructed by loose mold boxes positioned and secured by casting in mold frames by means of suitable molding material preferably consisting of or containing rubber.

I claim:

1. A mold for producing molded concrete items comprising:

a mold frame;

a plurality of spaced apart mold cavities contained within the mold frame for receiving concrete and forming of individual concrete items upon curing of the concrete received therein; and an elastic casting material positioning the plurality of spaced apart mold cavities within the mold frame while permitting movement of the mold cavities within the mold space with the elastic casting material contacting side walls of the mold and filling spaces between the spaced apart mold cavities and contacting outer walls of the spaced apart mold cavities.

2. A mold in accordance with claim 1 wherein:

the mold cavities are mold boxes with each mold box having side walls which are closed to define each mold cavity; and the mold boxes are uniformly spaced apart.

3. A mold in accordance with claim 2 wherein:

the mold boxes comprise steel.

4. A mold in accordance with claim 1 wherein:

the elastic casting material comprises rubber.

5. A mold in accordance with claim 1 wherein:

the elastic material consists of rubber.

6. A mold in accordance with claim 2 wherein:

the elastic casting material comprises rubber.

7. A mold in accordance with claim 2 wherein:

the elastic material consists of rubber.

8. A mold in accordance with claim 3 wherein:

the elastic casting material comprises rubber.

9. A mold in accordance with claim 3 wherein:

the elastic material consists of rubber.

10. A mold in accordance with claim 1 wherein the mold cavities extend below the mold frame.

11. A mold in accordance with claim 1 wherein:

the mold cavities and the elastic casting material extend below the mold frame.

12. A mold in accordance with claim 2 wherein:

the mold boxes extend below the mold frame.

13. A mold in accordance with claim 2 wherein:

the mold boxes and the elastic casting material extend below the mold frame.

14. A mold in accordance with claim 3 wherein:

the mold boxes extend below the mold frame.

15. A mold in accordance with claim 3 wherein:

the mold boxes and the elastic casting material extend below the mold frame.

16. A mold in accordance with claim 4 wherein the mold cavities extend below the mold frame.

17. A mold in accordance with claim 4 wherein:

the mold cavities and the elastic casting material extend below the mold frame.

18. A mold in accordance with claim 5 wherein the mold cavities extend below the mold frame.

19. A mold in accordance with claim 5 wherein:

the mold cavities and the elastic casting material extend below the mold frame.

20. A mold in accordance with claim 6 wherein:

the mold boxes extend below the mold frame.

21. A mold in accordance with claim 6 wherein:

the mold boxes and the elastic casting material extend below the mold frame.

22. A mold in accordance with claim 7 wherein:

the mold boxes extend below the mold frame.

23. A mold in accordance with claim 7 wherein:

the mold boxes and the elastic casting material extend below the mold frame.

24. A mold in accordance with claim 8 wherein:

the mold boxes extend below the mold frame.

25. A mold in accordance with claim 8 wherein:

the mold boxes and the elastic casting material extend below the mold frame.

26. A mold in accordance with claim 9 wherein:

the mold boxes extend below the mold frame.

27. A mold in accordance with claim 9 wherein:

the mold boxes and the elastic casting material extend below the mold frame.

* * * * *